US009796459B2

(12) United States Patent
Huang

(10) Patent No.: US 9,796,459 B2
(45) Date of Patent: Oct. 24, 2017

(54) OFFSHORE FLOATING SUPPORT APPARATUS

(71) Applicant: Kuo-Chang Huang, Tainan (TW)

(72) Inventor: Kuo-Chang Huang, Tainan (TW)

( * ) Notice: Subject to any disclaimer, the term of this patent is extended or adjusted under 35 U.S.C. 154(b) by 152 days.

(21) Appl. No.: 14/866,144

(22) Filed: Sep. 25, 2015

(65) Prior Publication Data

US 2016/0096599 A1 Apr. 7, 2016

(30) Foreign Application Priority Data

Oct. 1, 2014 (TW) ..... 103134205 A

(51) Int. Cl.

| | |
|---|---|
| ***B63B 21/50*** | (2006.01) |
| ***B63B 39/03*** | (2006.01) |
| ***B63B 35/44*** | (2006.01) |
| *B63B 1/12* | (2006.01) |
| *B63B 1/14* | (2006.01) |

(52) U.S. Cl.

CPC ..... *B63B 39/03* (2013.01); *B63B 21/50* (2013.01); *B63B 35/44* (2013.01); *B63B 2001/126* (2013.01); *B63B 2001/145* (2013.01); *B63B 2021/505* (2013.01); *B63B 2035/446* (2013.01)

(58) Field of Classification Search

CPC ..... B63B 2001/128; B63B 2001/044; B63B 35/4413

See application file for complete search history.

(56) References Cited

U.S. PATENT DOCUMENTS

| | | | | |
|---|---|---|---|---|
| 3,837,309 | A * | 9/1974 | Biewer | B63B 35/4413 114/265 |
| 5,295,557 | A * | 3/1994 | Taylor | E02D 29/12 182/113 |
| 5,435,262 | A * | 7/1995 | Grinius | B63B 22/021 114/264 |
| 2012/0107052 | A1 * | 5/2012 | Finn | B63B 21/50 405/200 |

* cited by examiner

*Primary Examiner* — Edwin Swinehart
(74) *Attorney, Agent, or Firm* — DLA Piper LLP (US)

(57) ABSTRACT

An offshore floating support apparatus includes an underwater base, an anchor unit and a plurality of supporting units. The anchor unit is connected to the underwater base and is adapted to be attached to a water bed. The supporting units are connected to and surround the underwater base. Each of the supporting units has a support member that defines a receiving space for receiving water therein and that has a valve component operable to establish fluid communication between the receiving space and external environment for adjusting quantity of water received in the support member.

13 Claims, 5 Drawing Sheets

OFFSHORE FLOATING SUPPORT APPARATUS

CROSS-REFERENCE TO RELATED APPLICATION

This application claims priority of Taiwanese Patent Application No. 103134205, filed on Oct. 1, 2014.

FIELD

The disclosure relates to a support apparatus, more particularly to an offshore floating support apparatus.

BACKGROUND

Referring to FIG. 1, a conventional offshore support apparatus is shown to include a supporting platform 81 for supporting devices such as wind turbines of a wind power generator, and a plurality of securing columns 82 extending downwardly from the supporting platform 81 to be fixedly secured at a water bed 80. However, such conventional offshore support apparatus cannot be implemented at deep water areas due to the relatively high construction cost and time. As such, another conventional offshore floating support apparatus may be adopted, where the securing columns are omitted. However, such conventional offshore floating support apparatus cannot provide stable operation since it can be easily affected by weather conditions such as strong waves.

SUMMARY

Therefore, an object of the disclosure is to provide an offshore floating support apparatus that may alleviate at least one of the drawbacks of the prior arts.

According to the disclosure, an offshore floating support apparatus includes an underwater base, an anchor unit and a plurality of supporting units. The anchor unit is connected to the underwater base and is adapted to be attached to a water bed. The supporting units are connected to and surround the underwater base. Each of the supporting units has a support member that defines a receiving space for receiving water therein and that has a value component operable to establish fluid communication between the receiving space and external environment for adjusting quantity of water received in the support member.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
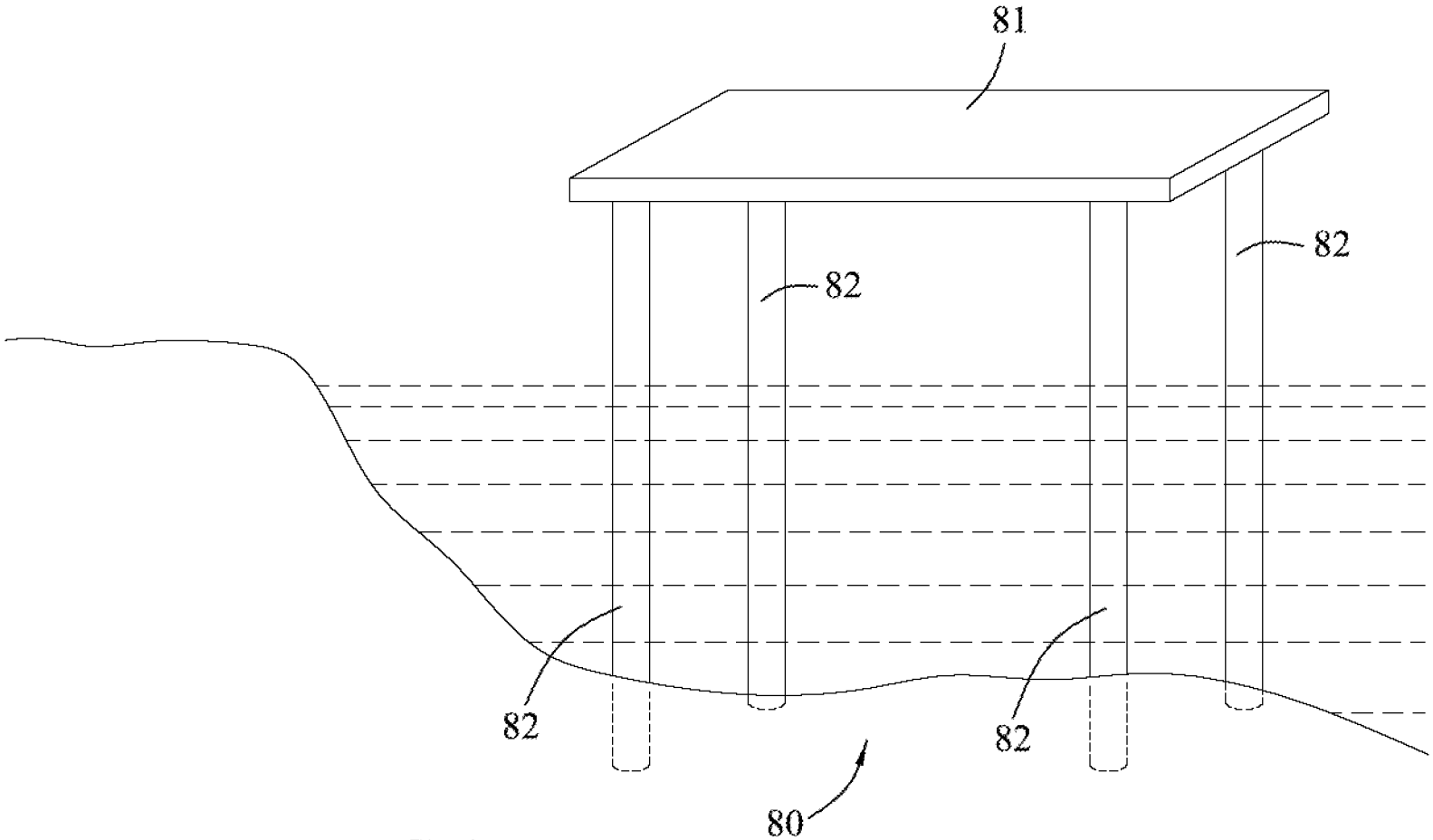
FIG.1 PRIOR ART
FIG. 1 is a perspective view illustrating a conventional support apparatus.

Before the disclosure is described in greater detail, it should be noted that like elements are denoted by the same reference numerals throughout the disclosure.

Figure 2:
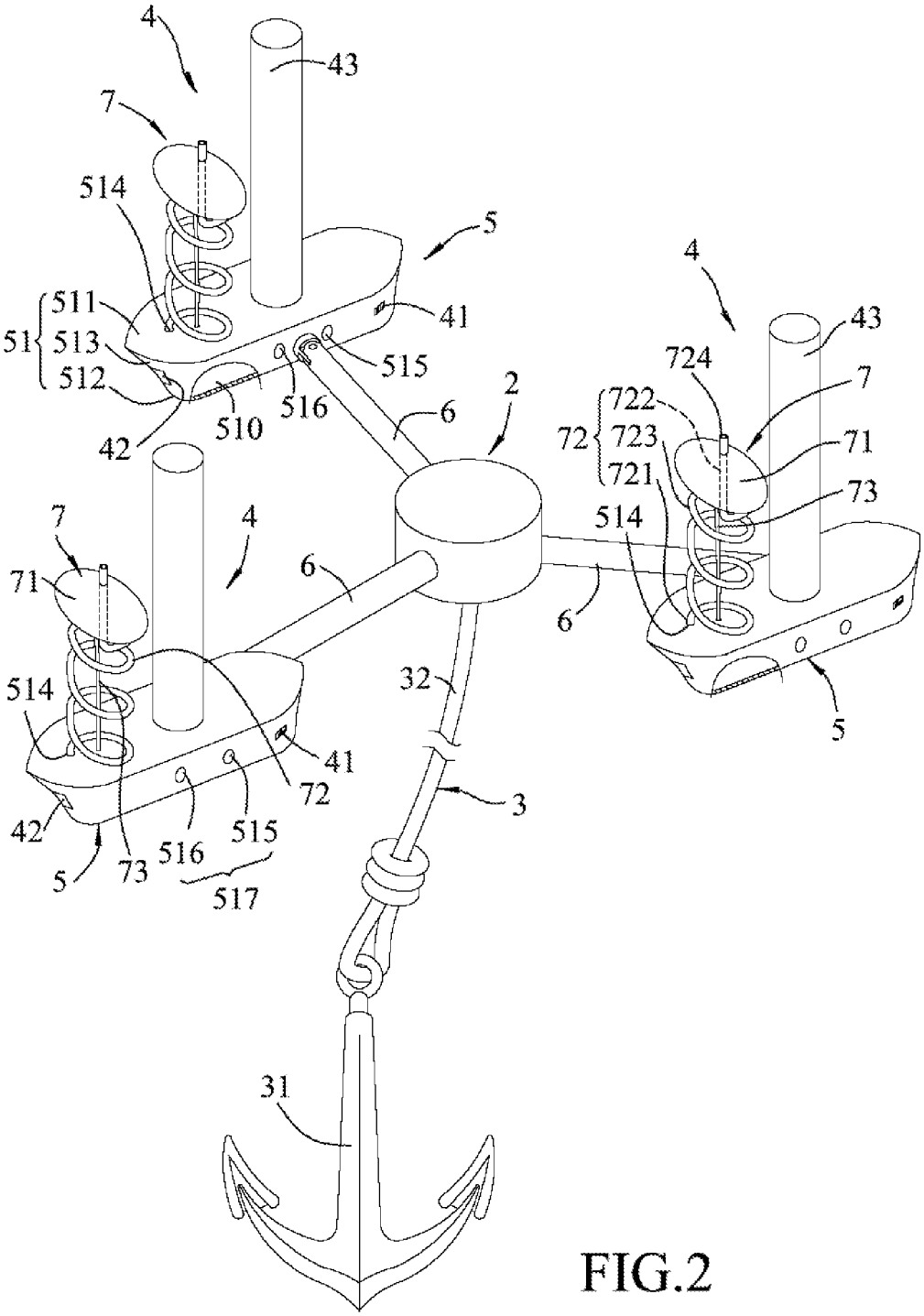
FIG. 2 is a perspective view, illustrating a first exemplary embodiment of an offshore floating support apparatus according to the present disclosure.
Figure 3:
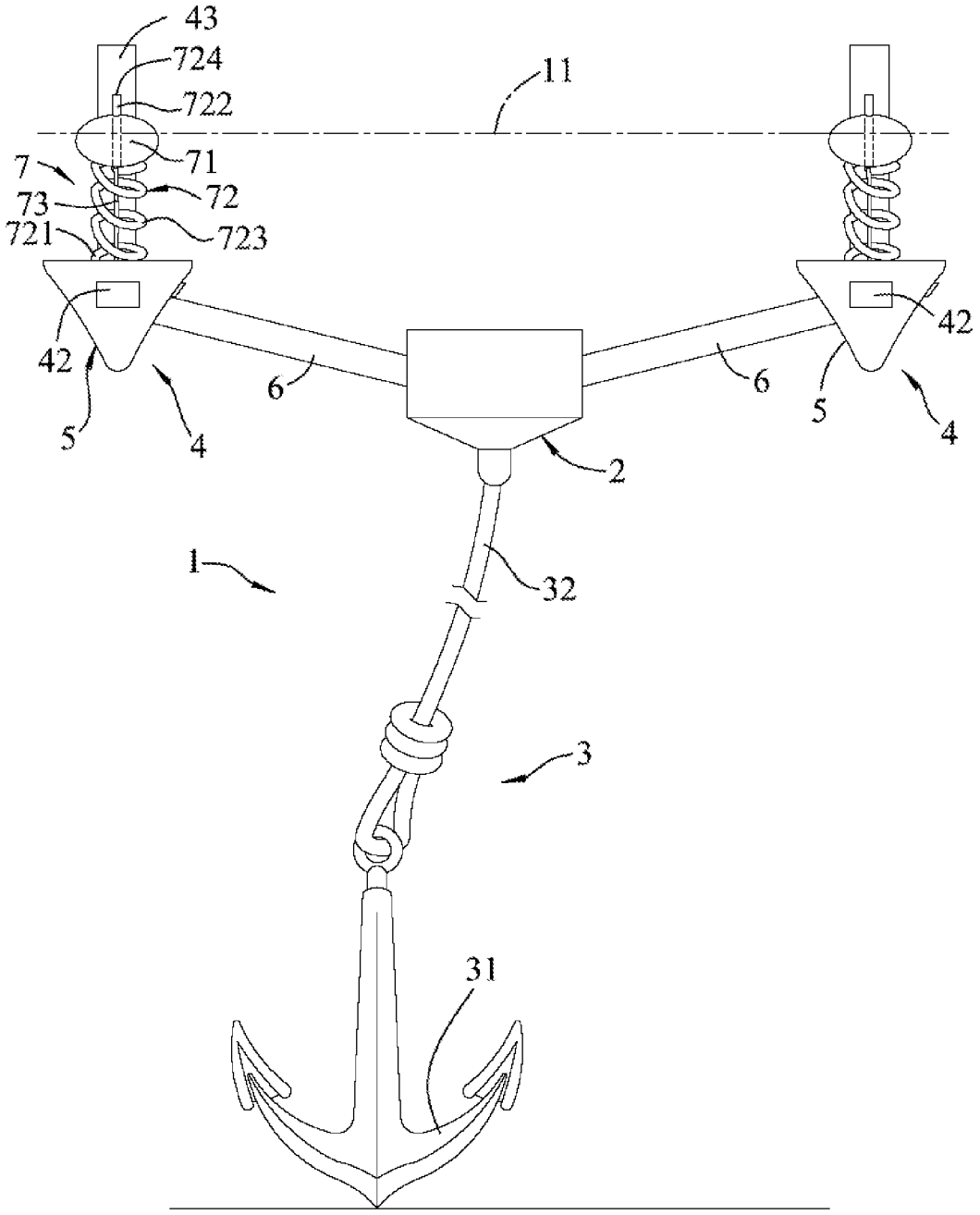
FIG. 3 is a side view of the first exemplary embodiment.
Figure 4:
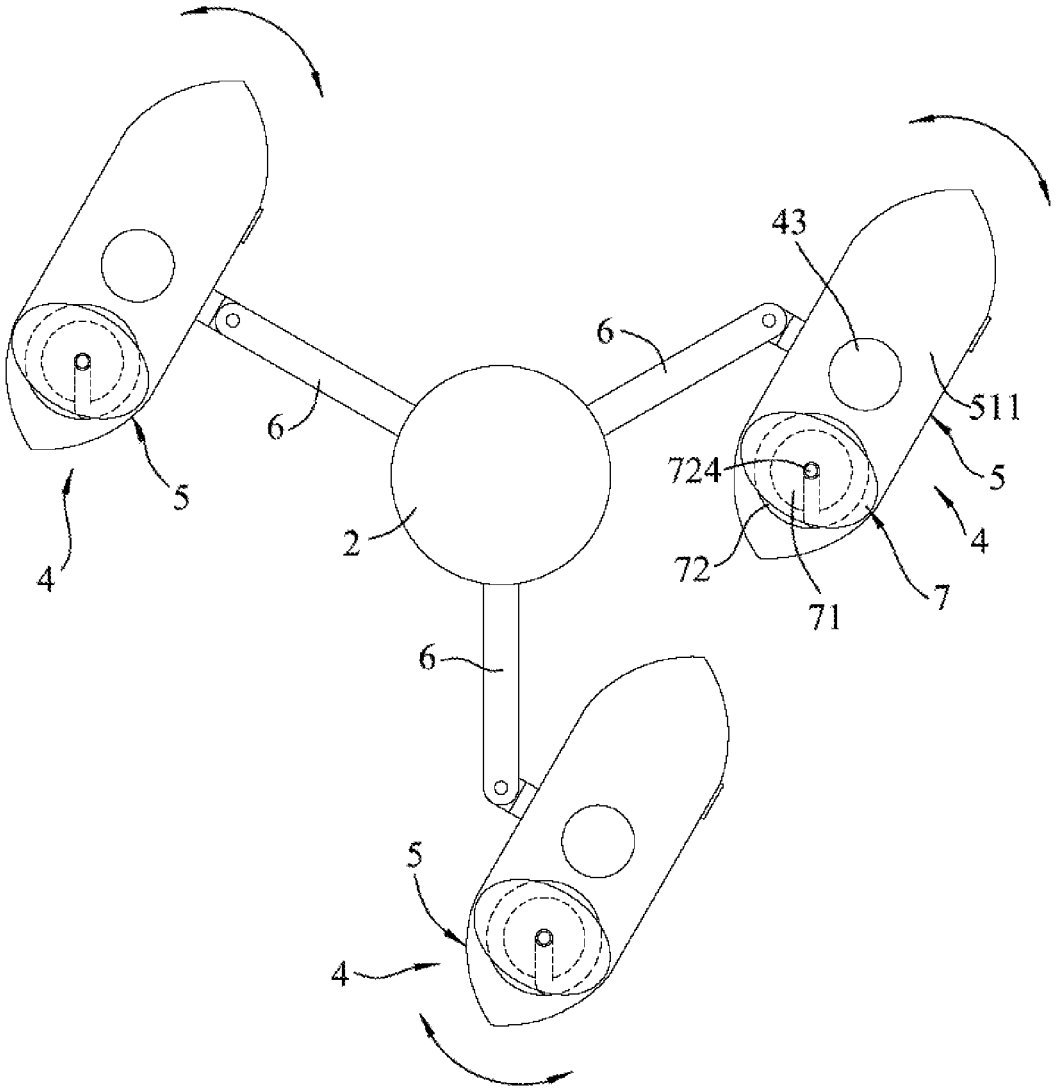
FIG. 4 is a top view of the first exemplary embodiment.

Referring to FIGS. 2 to 4, the first exemplary embodiment of an offshore floating support apparatus according to the present disclosure is adapted to be disposed at a water surface 11 of a water body 1 (such as oceans, lakes or rivers) and includes an underwater base 2, an anchor unit 3, and a plurality of supporting units 4.

The underwater base 2 is disposed under the water surface 11 for maintaining suspension of the supporting units 4. In this embodiment, the underwater base 2 may be configured to have a hollow body filled with a filler material to provide sufficient weight therefor to prevent reclining of the supporting units 4. The filler material may include metals, concrete, polymeric materials, nontoxic construction disposals such as bricks, rocks, pebbles, glasses, ceramics, sands and so forth.

The anchor unit 3 is connected to the underwater base 2 and includes an anchor element 31 that is adapted to be attached to a water bed under the water surface 11 and that is spaced apart from the underwater base 2, and an anchor-connecting element 32 that interconnects the underwater base 2 and the anchor element 31. The anchor element 31 may be an anchor block or other weight objects which may contain filler materials, such as metals, concrete, rocks, pebbles, sands, glasses, ceramics, bricks and the like, to provide sufficient weight for keeping the underwater base 2 suspended below the water surface 11. The anchor-connecting element 32 may be a chain, a wire rope, a flexible tube, a rope or the like, and can be made of materials such as metals, polymeric materials and so forth.

As shown in 2, the supporting units 4 are connected to the underwater base 2 and surround the underwater base in a mutually spaced-apart manner. In this embodiment, the supporting units 4 are annularly arranged with respect to the underwater base 2. It should be noted that the number of the supporting units 4 is not limited according to the present disclosure, e.g., three supporting units 4 are included in the offshore floating support apparatus of this embodiment as illustrated FIGS. 2 and 4. Each of the supporting units 4 of this embodiment has a support member 5 disposed proximate to the water surface 11, a connecting arm 6 interconnecting the underwater base 2 and a corresponding one of the support members 5, and an air-tube assembly 7 disposed at the corresponding one of the support members 5.

The support member 5 of each of the supporting units 4 defines a receiving space 510 for receiving water therein and has a valve component 517 operable to establish fluid communication between the receiving space 510 and external environment for adjusting quantity of water received in the support member 5. In this embodiment, as shown in FIG. 2, each support member 5 is configured into a streamlined boat shape and has opposite top and bottom walls 511, 512 and a surrounding wall 513 that cooperates with the top and bottom walls 511, 512 to define the receiving space 510 and that is provided with the valve component 517. In certain embodiments, the surrounding wall 513 of the support member 5 may be further provided with flow-deflecting plates (not shown in the drawings) to enhance stability of support members 5. The valve component 517 may include at least one water passage formed at the surrounding wall 513 to communicate fluidly the receiving space 510 and the external environment, and a water gate (not shown) disposed at the water passage and operable to establish or cease the fluid communication. In this embodiment, two water passages, i.e., a water inlet passage 515 and a water outlet passage 516, are formed at the surrounding wall 513 of each of the support member 5. Each of the supporting units 4 may further have a water pump 42 disposed at the corresponding one of the support members 5 and configured for pumping water into or out of the receiving space 510 through the water passages when the water gate is opened. As illustrated in FIG. 2, in this embodiment, each of the supporting units 4 further has a control switch 41 being provided on the support member 5 and operable to control the water gate to establish or cease the fluid communication. The control switch 41 may be operated by any suitable means, such as manual operation or wired/wireless communication.

The air tube assembly 7 includes an air tube 72, a floating element 71, and a connecting member 73 interconnecting the floating element 71 and the air tube 72. In greater detail, as shown in FIGS. 2 and 3, the air tube 72 has a connecting end section 721, an overwater section 722 and a helical section 723 interconnecting the connecting end section 721 and the overwater section 722. The connecting end section 721 is connected to the corresponding one of the support members 5 and is in air communication with the receiving space 510 via a through hole 514 formed in the top wall 511 of the corresponding one of the support members 5. The overwater section 722 defines an opening 724 for enabling air communication between the receiving space 510 and atmosphere through the air tube 72, so that the air pressure in the receiving space 510 can be maintained at the atmospheric pressure. The floating element 71, which may be configured as a hollow sphere, is attached to the overwater section 722 of the air tube 72 to provide buoyant force therefor and is disposed under a top end of the air tube 72. As illustrated in FIG. 3, in this embodiment, the overwater section 722 of the air tube 72 extends through and protrudes upwardly from the floating element 71 to be above the water surface 11. It is worth noting that the helical section 723 of each air tube 72 is flexible such that the vertical length thereof is variable for keeping the overwater section 722 being above the water surface 11 when the support member 5 is at different depths. The connecting member 73, which may be a wire or a rope, is disposed to be surrounded by the helical section 723 of the air tube 72, thereby being protected by the helical section 723 from collision with other floating objects. Similar to the helical section 723 of the air tube 72, the connecting member 73 may also be flexible such that the vertical length thereof is variable.

As shown in FIG. 4, the connecting arm 6 of each of the supporting units 4 is rigid and extends inclinedly from the corresponding one of the support members 5 toward the underwater base 2. In addition, each connecting arm 6 is fixedly connected to the underwater base 2 while being pivotally connected to a respective one of the support members 5 so as to allow the respective one of support members 5 to rotate horizontally relative thereto as indicated in FIG. 4. Thus, the support members 5 can rotate in accordance with water flows for reducing the impact caused thereby.

It should be noted that, in this embodiment, the supporting unit 4 may further include an overwater support column 43 that extends upwardly from the support member 5 to protrude from the water surface 11 and that is adapted to support other apparatuses such as wind turbines of a wind power generator, work machines, cargos, workshops, etc. The inclusion of the overwater support column 43 may allow the apparatuses to be supported at a relatively high level and avoid wave impact.

When using the offshore floating support apparatus of this embodiment in the water body 1, the anchor unit 3 is adapted to be attached on the water bed of the water body 1 for limiting the location of the offshore floating support apparatus within a specific range. The support members 5 of the supporting units 4 suspend under the water surface 11 of the water body 1 at a predetermined depth which is correlated to the quantity of water received in the receiving space 510 of the support member 5. By adjusting the quantity of water in the support member 5 utilizing the valve component 517 and/or the water pump 42 of the support unit 4, the suspension depth of the support member 5 can be adjusted due to variation of the buoyant force attributed to the quantity of water received in the support member 5. For example, if the support members 5 need to be closer to the water surface 11 for raising up the apparatuses to be supported, one may control the control switch 41 to open the water gate in the water inlet passage 515 so as to establish the fluid communication between the receiving space 510 and the external environment (i.e., the water body 1) and to allow water to flow into the receiving space 510. On the other hand, if the support members 5 need to be placed deeper into the water body 1 to avoid strong waves, one may control the control switch 41 to open the water gate in the water outlet passage 516 and to pump the water out of the receiving space 510 using the water pump 42. When the water is flowing into or out of the receiving space 510, the air pressure in the receiving space 510 is maintained at the same as the atmospheric pressure owing to the presence of the air tube 72 of the air tube assembly 7. By controlling the support members 5 to be suspended at different depths under the water surface 11, the offshore floating support apparatus of the present disclosure can be relatively stable at various weather/working conditions.

Figure 5:
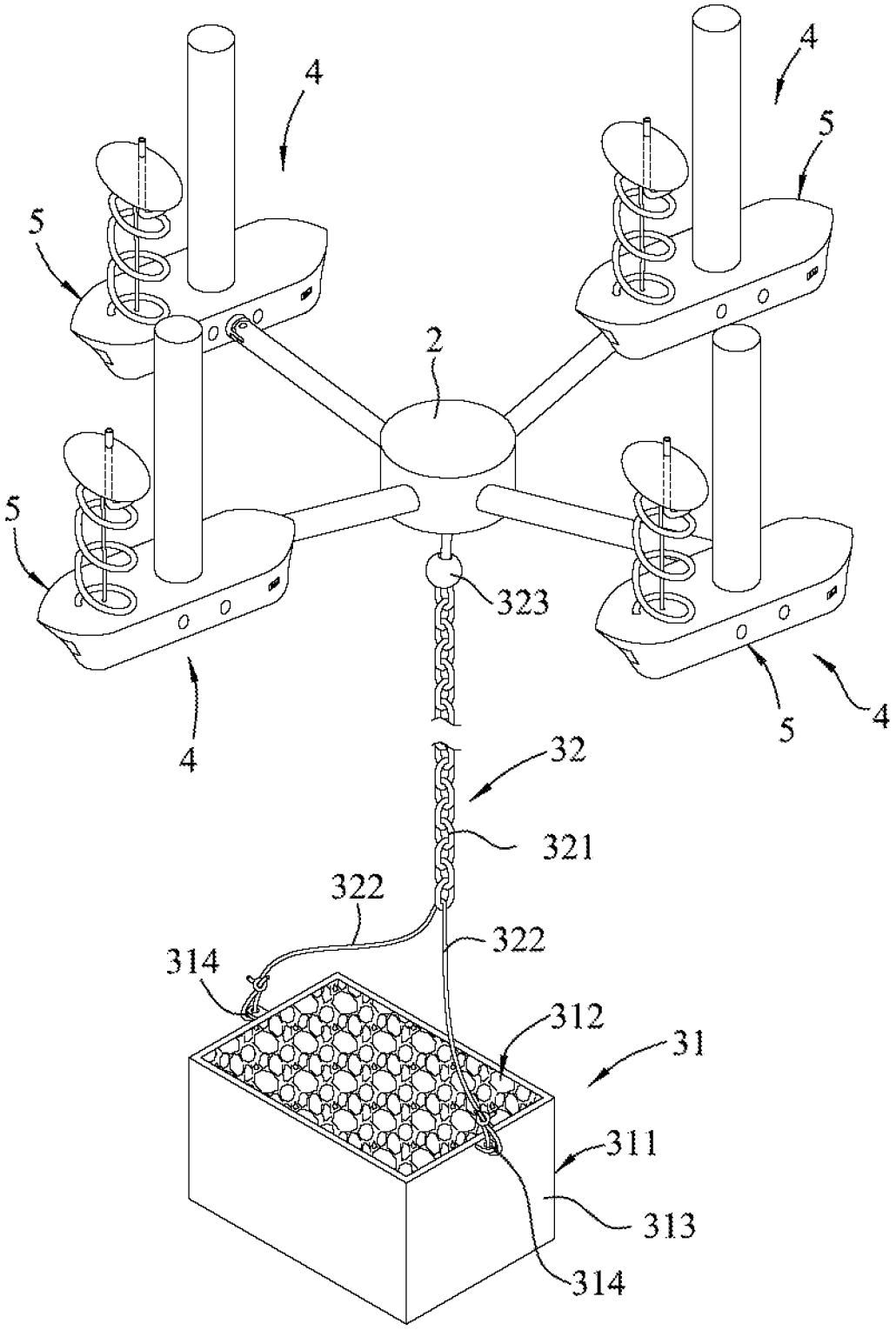
FIG. 5 is a perspective view of a second exemplary embodiment of the offshore floating support apparatus according to the present disclosure.

Referring to 5, the second exemplary embodiment of the offshore floating support apparatus according to the present disclosure is similar to that of the first exemplary embodiment, with the only differences residing in the number of the supporting units 4 and the configuration of the anchor unit 3. As shown in FIG. 5, in this embodiment, the number of the supporting units 4 being included in offshore floating support apparatus is four. In addition, the anchor element 31 of the second exemplary embodiment includes a hollow seat 311, which has a shell 313 and a pair of hanging parts 314 provided on opposite sides of the shell 313, and a filler material 312 filled in the shell 313 of the hollow seat 311. The shell 313 may be made of a material including concrete, metals, ceramics, polymeric materials and the like, and the filler material 312 may include nontoxic disposals such as sands, soil, rocks, pebbles, bricks and the like. The anchor-connecting element 32 of the second exemplary embodiment may include a universal joint 323 that is connected to the underwater base 2 and that is rotatable relative to the underwater base 2, a first connecting section 321 extending from the universal joint 323, and a pair of second connecting parts 322 each of which is connected to a respective one of the hanging parts 314 of the anchor element 31. By virtue of the universal joint 323, when the underwater base 2 and the supporting units 4 are rotated by the water flows, the anchor element 31 and the first and second connecting sections 321, 322 of the anchor-connecting element 32 can remain still, so as to prevent twisting of the anchor-connecting element 32. The offshore floating support apparatus of the second exemplary embodiment has advantages similar to those of the first exemplary embodiment.

While the disclosure has been described in connection with what is considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An offshore floating support apparatus, comprising:

an underwater base;

an anchor unit connected to said underwater base and adapted to be attached to a water bed; and a plurality of supporting units connected to and surrounding said underwater base, each of said supporting units having a support member that defines a receiving space for receiving water therein and that has a valve component operable to establish fluid communication between said receiving space of said support member and external environment for adjusting quantity of water received in said support member;

wherein each of said supporting units further has an air tube assembly including an air tube having a connecting end section that is connected to said corresponding one of said support members of said supporting units and that is in air communication with said receiving space, and an overwater section that defines an opening for enabling air communication between said receiving space and atmosphere through said air tube; and wherein said air tube assembly of each of said supporting units further has a floating element that is attached to said overwater section of said air tube to provide buoyant force therefor and that is disposed under a top end of said air tube.

2. The offshore floating support apparatus according to claim 1, wherein each of said supporting units further has a water pump disposed at a corresponding one of said support members and configured for pumping water into or out of said receiving space.

3. The offshore floating support apparatus according to claim 1, wherein said overwater section of said air tube extends through and protrudes upwardly from said floating element.

4. The offshore floating support apparatus according to claim 1, wherein said air tube of said air tube assembly further has a helical section interconnecting said connecting end section and said overwater section, said air tube assembly of each of said supporting units further having a connecting member that is surrounded by said helical section of said air tube and that interconnects said floating element and said support member.

5. The offshore floating support apparatus according to claim 4, wherein said helical section of said air tube and said connecting member are flexible such that vertical lengths thereof are variable.

6. The offshore floating support apparatus according to claim 1, wherein each of said supporting units further has a connecting arm interconnecting said underwater base and a corresponding one of said support members of said supporting units.

7. The offshore floating support apparatus according to claim 6, wherein said connecting arms are fixedly connected to said underwater base.

8. The offshore floating support apparatus according to claim 6, wherein said connecting arms are pivotally connected to said support members.

9. The offshore floating support apparatus according to claim 6, wherein each of said connecting arms is rigid and extends inclinedly from said support member of the respective one of said supporting units toward said underwater base.

10. The offshore floating support apparatus according to claim 1, wherein said supporting units are annularly arranged.

11. The offshore floating support apparatus according to claim 1, wherein said anchor unit includes an anchor element that is spaced apart from said underwater base, and an anchor-connecting element that interconnects said underwater base and said anchor element.

12. The offshore floating support apparatus according to claim 1, wherein said support member of each of said supporting units has opposite top and bottom walls and a surrounding wall that interconnects said top and bottom walls and that cooperates with said top and bottom walls to define said receiving space.

13. The offshore floating support apparatus according to claim 1, wherein each of said supporting units further includes an overwater support column that extends upwardly from said support member.

* * * * *